US010959592B2

(12) United States Patent
Robinson et al.

(10) Patent No.: US 10,959,592 B2
(45) Date of Patent: Mar. 30, 2021

(54) PORTABLE LIQUID-RECYCLING LIQUID-REUSING CLEANING SYSTEM FOR HARD SURFACE FLOORING

(71) Applicants: Robert S. Robinson, Hamilton, OH (US); Robert G. Robinson, Hamilton, OH (US)

(72) Inventors: Robert S. Robinson, Hamilton, OH (US); Robert G. Robinson, Hamilton, OH (US)

(73) Assignee: Kaivac, Inc., Hamilton, OH (US)

( * ) Notice: Subject to any disclaimer, the term of this patent is extended or adjusted under 35 U.S.C. 154(b) by 0 days.

(21) Appl. No.: 15/065,832

(22) Filed: Mar. 10, 2016

(65) Prior Publication Data

US 2017/0258284 A1 Sep. 14, 2017

(51) Int. Cl.
*A47L 11/30* (2006.01)
*A47L 11/40* (2006.01)

(52) U.S. Cl.
CPC ..... *A47L 11/30* (2013.01); *A47L 11/4022* (2013.01); *A47L 11/4025* (2013.01); *A47L 11/4027* (2013.01); *A47L 11/4044* (2013.01); *A47L 11/4061* (2013.01); *A47L 11/4072* (2013.01); *A47L 11/4075* (2013.01); *A47L 11/4083* (2013.01); *A47L 11/4088* (2013.01)

(58) Field of Classification Search
None
See application file for complete search history.

(56) References Cited

U.S. PATENT DOCUMENTS

| | | | |
|---|---|---|---|
| 3,996,640 | A | 12/1976 | Blue |
| 4,741,069 | A | 5/1988 | Helm |
| 5,432,975 | A | 7/1995 | Hilmanowski |
| 5,768,742 | A | 6/1998 | Kohl |
| 6,857,162 | B1 | 2/2005 | Rasmussen |

(Continued)

FOREIGN PATENT DOCUMENTS

| | | |
|---|---|---|
| EP | 2 494 899 | 9/2012 |
| WO | WO1994017721 | 8/1994 |
| WO | WO 2013/019823 | 2/2013 |

OTHER PUBLICATIONS

International Search Report (6 pages) for Int'l Appl'n. No. PCT/162016/000843, Redelsperger, C. (Auth'd officer), dated Aug. 30, 2016 , EPO (Int'l Searching Authority).

*Primary Examiner* — Rita P Adhlakha
(74) *Attorney, Agent, or Firm* — David E. Pritchard

(57) ABSTRACT

A cleaning system may have a trolley bucket assembly, a vacuum recovery tank, and a vacuum motor assembly. The trolley bucket assembly may have a bucket, a wheeled chassis, and a spigot fluidly connected to the bucket. A user may dispense and regulate the flow of cleaning liquid from the bucket through the spigot by manually adjusting the spigot. The tank may hold cleaning liquid and soil, and may have a bottom wall, a vacuum recovery inlet, and a transfer outlet through which cleaning liquid may be transferred to the bucket for reuse. The bottom wall may have an interior surface; and the transfer outlet may have an entry opening through which cleaning liquid from the tank enters the transfer outlet. The entry opening may be positioned above a portion of the interior surface, thereby inhibiting soil that settles on the interior surface portion from passing through the transfer outlet.

23 Claims, 14 Drawing Sheets

(56) References Cited

U.S. PATENT DOCUMENTS

| | | | |
|---|---|---|---|
| 6,997,395 | B2 | 2/2006 | Kawamoto |
| 7,240,394 | B2 | 7/2007 | Kegg |
| 7,624,474 | B1 | 12/2009 | Cho |
| 8,465,597 | B2 | 6/2013 | Turner |
| 2002/0116783 | A1 | 8/2002 | Giddings et al. |
| 2005/0125935 | A1 | 6/2005 | Leonatti |
| 2008/0295864 | A1 | 12/2008 | Turner |
| 2009/0260177 | A1 | 10/2009 | Richards |
| 2015/0040945 | A1 | 2/2015 | Venard et al. |
| 2017/0095129 | A1* | 4/2017 | Richter ..... A47L 7/0004 |

* cited by examiner

PORTABLE LIQUID-RECYCLING LIQUID-REUSING CLEANING SYSTEM FOR HARD SURFACE FLOORING

CROSS-REFERENCE TO RELATED APPLICATION

This patent document claims the benefit of the filing date of Provisional Application No. 62/130,610, entitled "Liquid-Recycling Multi-Functional Cleaning and Floor Care System" and filed on Mar. 10, 2015. The entire disclosure of Provisional Application No. 62/130,610 is incorporated into this patent document by reference.

FIELD OF THE INVENTION

This invention relates to portable machines for cleaning hard surface flooring, and more particularly, to portable machines for cleaning hard surface flooring in which cleaning liquid is recycled and reused.

BACKGROUND OF THE INVENTION

In areas of the United States and in other areas of the world, water is becoming less available, due in part to droughts, population increases, and the like. In fact, in some areas, water is either scarce or not available. In addition, in many areas, water consumption and water cost are increasing. Accordingly, organizations and individuals are looking for ways to conserve water and to reduce water consumption, including for example recycling and reusing water when possible and appropriate to do so.

One proposed aspect of water recycling and reuse involves the recycling and reuse of so-called "gray water." Gray water is a term used to describe the relatively clean waste water from sinks, showers, baths, dish washing machines, clothes washing machines, and the like—things that are found in many residential, commercial, industrial, and institutional buildings.

The process of cleaning, especially cleaning of commercial, industrial, and institutional buildings and other facilities, can consume a great deal of water. Accordingly, the use of gray water in cleaning has been proposed. This might include using gray water by itself or in combination with other cleaning chemicals. It also might include using gray water with various cleaning machines or other cleaning equipment. Another way to conserve water in the cleaning process is to recycle and reuse cleaning water—either potable water or gray water.

Although some ideas to address water conservation issues have been proposed, additional solutions are needed.

SUMMARY OF THE INVENTION

One aspect of the invention is directed to a portable liquid-recycling liquid-reusing cleaning system for use in cleaning hard surface flooring. The cleaning system may include a trolley bucket assembly, a vacuum recovery tank positioned on the trolley bucket assembly, and a vacuum motor assembly fluidly connected to the vacuum recovery tank.

In further detail, the trolley bucket assembly may include: a bucket operable to hold cleaning liquid; a wheeled chassis; and a spigot fluidly connected to the bucket, the spigot including a valve that is adjustable throughout a range from a fully open position to a fully closed position, whereby when the bucket contains cleaning liquid, a user may dispense and regulate the flow of cleaning liquid from the bucket through the spigot by manually adjusting the spigot.

The vacuum recovery tank may be operable to hold cleaning liquid and soil, and the vacuum recovery tank may include a bottom wall, a vacuum recovery inlet, and a cleaning liquid transfer outlet through which cleaning liquid from the vacuum recovery tank may be transferred to the bucket for reuse. The vacuum recovery tank bottom wall may include an interior surface; and the cleaning liquid transfer outlet may include a cleaning liquid entry opening through which cleaning liquid from the vacuum recovery tank may enter the cleaning liquid transfer outlet.

The cleaning liquid entry opening of the cleaning liquid transfer outlet may be positioned above at least a portion of the vacuum recovery tank bottom wall interior surface, thereby inhibiting soil that settles on the portion of the vacuum recovery tank bottom wall interior surface from passing through the vacuum recovery tank cleaning liquid transfer outlet.

In this fashion, a user may dispense cleaning liquid from the bucket through the spigot onto hard surface flooring, may vacuum dispensed cleaning liquid and soil from hard surface flooring through the vacuum recovery inlet into the vacuum recovery tank, may transfer recovered cleaning liquid from the vacuum recovery tank through the cleaning liquid transfer outlet to the bucket for reuse, and may dispense transferred cleaning liquid from the bucket through the spigot onto hard surface flooring.

Another aspect of the invention is directed to a method of cleaning hard surface flooring with a portable liquid-recycling liquid-reusing cleaning system. The method may include: providing a portable liquid-recycling liquid-reusing cleaning system (such as, for example, the cleaning system described above); filling at least a portion of the bucket with a cleaning liquid; dispensing at least a portion of the cleaning liquid from the bucket onto hard surface flooring via the spigot by manually adjusting the spigot; vacuuming soil and at least some of the portion of the dispensed cleaning liquid from the hard surface flooring into the vacuum recovery tank via the vacuum recovery inlet, thereby removing soil and recovering cleaning liquid from hard surface flooring; and transferring at least a portion of the recovered cleaning liquid from the vacuum recovery tank into the bucket via the cleaning liquid transfer outlet.

BRIEF DESCRIPTION OF THE DRAWINGS

The accompanying drawings, which are incorporated into this patent document and constitute a part of this specification, illustrate embodiments of the invention and, together with the general description of the invention given above, and the detailed description of the drawings given below, serve to explain the principles of the invention.

DETAILED DESCRIPTION OF THE DRAWINGS

Figure 1:
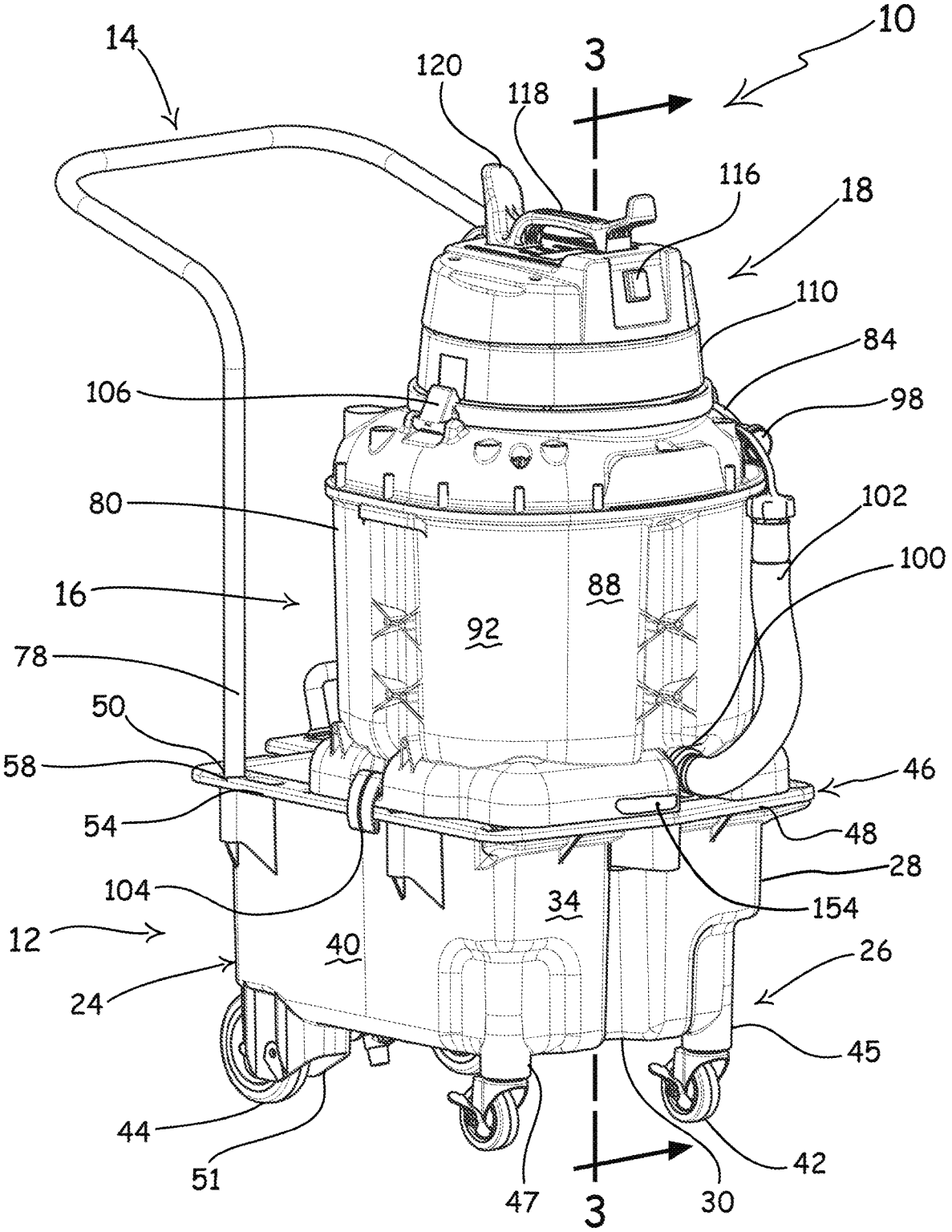
FIG. 1 is a perspective view of an embodiment of the portable liquid-recycling liquid-reusing cleaning system for hard surface flooring, in accordance with the principles of the invention.
Figure 2:
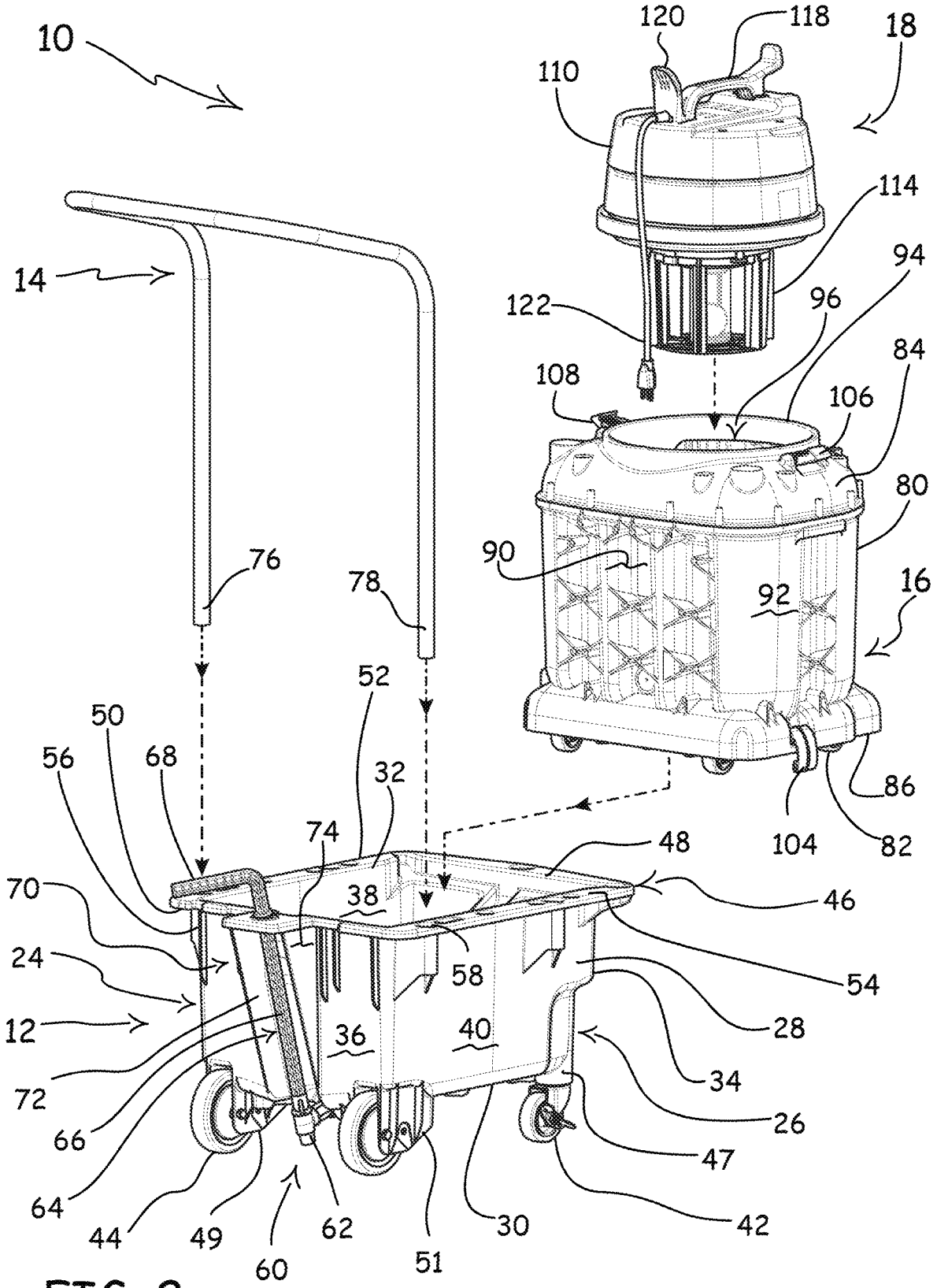
FIG. 2 is an exploded view of the portable liquid-recycling liquid-reusing cleaning system of FIG. 1.

With reference to FIGS. 1-4, a particular embodiment 10 of the portable liquid-recycling liquid-reusing cleaning system for hard surface flooring, in accordance with the principles of the invention, is shown. The portable floor care system embodiment 10 has a trolley bucket assembly 12, a handle in the form of a four-bend handle 14, a vacuum recovery tank assembly 16, and a vacuum motor head assembly 18 fluidly connected to the vacuum recovery tank assembly.

The trolley bucket assembly 12 has a bucket 24 operable to hold cleaning liquid, a wheeled chassis 26, and a spigot 62 fluidly connected to the bucket 24. The spigot has a valve that is adjustable throughout a range from a fully open position to a fully closed position, whereby when the bucket contains cleaning liquid, a user may dispense and regulate the flow of cleaning liquid from the bucket through the spigot by manually adjusting the spigot.

The vacuum recovery tank assembly 16 has a vacuum recovery tank 80 positioned on the trolley bucket assembly 12. The vacuum recovery tank is operable to hold cleaning liquid and soil. The vacuum recovery tank has a bottom wall 86, a vacuum recovery inlet 98, and a cleaning liquid transfer outlet through which cleaning liquid from the vacuum recovery tank may be transferred to the bucket 24 for reuse. The bottom wall 86 has an interior surface 87. The cleaning liquid transfer outlet has cleaning liquid entry openings (as at 105 in FIG. 4) through which cleaning liquid from the vacuum recovery tank 80 enters the cleaning liquid transfer outlet. The cleaning liquid entry openings are openings in a "gazeebo" nut 148 at an upper end of a standpipe 144 (see FIGS. 3 and 4). In addition, a vacuum motor assembly 112 is fluidly connected to the vacuum recovery tank 80.

The cleaning liquid entry openings (as at 105 in FIG. 4) of the cleaning liquid transfer outlet are positioned above at least a portion of the vacuum recovery tank bottom wall interior surface 87, thereby inhibiting soil that settles on the portion of the vacuum recovery tank bottom wall interior surface 87 from passing through the vacuum recovery tank cleaning liquid transfer outlet.

In this fashion, a user may dispense cleaning liquid from the bucket 24 through the spigot 62 onto hard surface flooring, may vacuum dispensed cleaning liquid and soil from hard surface flooring through the vacuum recovery inlet 98 into the vacuum recovery tank 80, may transfer recovered cleaning liquid from the vacuum recovery tank 80 through the cleaning liquid transfer outlet to the bucket 24 for reuse, and may dispense transferred cleaning liquid from the bucket 24 through the spigot 62 onto hard surface flooring.

The trolley bucket assembly 12 has a bucket 24 and a wheeled chassis 26 integral with the bucket. The bucket has a circumferential sidewall 28, a bottom wall 30, and an upper end 32—with the circumferential sidewall including a front wall 34, a back wall 36, a left sidewall 38, and a right sidewall 40. The bucket defines an interior space, and the bucket upper end defines an opening—with the bucket capable of holding a cleaning liquid (e.g., water or another cleaning liquid or solution). The wheeled chassis has four wheels—two swivel casters at the front (as at 42), and two fixed-axle wheels at the back (as at 44). At the front, the wheeled chassis includes a reinforced post or leg 45 at the front lower-left corner, and a reinforced post or leg 47 at the front lower-right corner. Each of these legs includes a cylindrical bore for receiving the post of the corresponding caster. At the back, the wheeled chassis includes a wheel frame 49 at the back lower-left corner, and a wheel frame 51 at the back lower-right corner.

The bucket 24 further has a top wall 46 at the bucket upper end 32. The top wall is integral with the circumferential sidewall 28, and extends outward away from the circumferential sidewall and bucket interior space. The top wall has a front section 48, a back section 50, a left section 52, and a right section 54—with each top wall section integral with an adjacent top wall section. The top wall left section has a cylindrical bore 56; and the top wall right section has a cylindrical bore 58. Each of the cylindrical bores has a bottom wall, with the bottom wall including an opening for drainage. One way in which the cylindrical bores 56, 58 may be used is discussed below, in connection with the four-bend handle 14.

The trolley bucket assembly 12 further has a spigot assembly 60 at the back of the bucket 24. The spigot assembly includes a spigot 62 and a spigot handle 64 connected to the spigot. The spigot is fluidly connected to the bucket interior space; and the spigot has a valve that facilitates the spigot's ability to dispense and regulate the flow of a cleaning liquid from the reservoir through the spigot. The spigot handle is an elongated member in the form of an elongated rod that extends upward from the spigot. The spigot handle has an upwardly extending section 66 and a horizontal section 68 at the top of the upwardly extending section. A frame 70 extends rearward from the back wall 36 of the bucket; and the upwardly extending section of the spigot handle extends through an opening in the top wall of the frame. In further detail, the frame includes the top wall (a portion of the back section 50 of the top wall 46 of the bucket 24), a left sidewall 72, and a right sidewall 74. The left sidewall is positioned to the left of the spigot-handle upwardly extending section; and the right sidewall is positioned to the right of the spigot-handle upwardly extending section. The left and right sidewalls extend rearward from the bucket back wall and are integral with the bucket back wall and the frame top wall.

In use, a user typically operates the spigot handle 64 by grasping the horizontal section 68 and turning the section to the right or to the left. The spigot 62 is manually adjustable through a range from a fully open position to a fully closed position, whereby when the bucket 24 contains a cleaning liquid, a user may dispense and regulate the flow of the cleaning liquid from the bucket through the spigot by manually turning the spigot handle a desired amount to the right or to the left, thereby adjusting the spigot.

Various embodiments of the portable liquid-recycling liquid-reusing cleaning system, in accordance with the principles of the invention, may be configured: (1) so that at least a portion of the cleaning liquid dispensed from the bucket through the spigot flows directly from the spigot onto an area of hard surface flooring; (2) so that all of the cleaning liquid dispensed from the bucket through the spigot flows directly from the spigot onto an area of hard surface flooring; (3) so that at least a portion of the cleaning liquid dispensed from the bucket through the spigot flows indirectly from the spigot onto an area of hard surface flooring; and (4) so that all of the cleaning liquid dispensed from the bucket through the spigot flows indirectly from the spigot onto an area of hard surface flooring. One example of cleaning liquid flowing indirectly from the spigot onto an area of hard surface flooring involves a configuration in which cleaning liquid flows from the spigot to a liquid spreader device or assembly, and from the liquid spreader device or assembly to the hard surface flooring.

Additional aspects of the trolley bucket assembly are shown and described in: (1) U.S. Pat. No. 8,544,141, entitled "Cleaning Cart Systems" and issued on Oct. 1, 2013, (2) U.S. patent application Ser. No. 13/477,040, entitled "Modular Multi-Functional Cleaning and Floor Care System" and filed on May 21, 2012; and (3) U.S. Patent Application Publication No. US 2013/0125335, entitled "Modular Multi-Functional Cleaning and Floor Care System" and published on May 23, 2013. The entire disclosure of each of (1) U.S. Pat. No. 8,544,141, (2) U.S. patent application Ser. No. 13/477,040, and (3) U.S. Patent Application Publication No. US 2013/0125335 is incorporated into this patent document by reference.

Further aspects of the trolley bucket assembly are shown and described in: (1) U.S. patent application Ser. No. 13/563,718, entitled "Multi-Functional Cleaning and Floor Care System" and filed on Jul. 31, 2012; and (2) U.S. Patent Application Publication No. US 2013/0139346, entitled "Multi-Functional Cleaning and Floor Care System" and published on Jun. 6, 2013. The entire disclosure of each of (1) U.S. patent application Ser. No. 13/563,718 and (2) U.S. Patent Application Publication No. US 2013/0139346 is incorporated into this patent document by reference.

The vacuum recovery tank assembly 16 includes a vacuum recovery tank 80, four swivel caster wheels (as at 82) at the base of the tank, a dump hose 102 at the front of the tank, two fasteners in the form of hand-operable latches (as at 104) at the base of the tank, and two fasteners in the form of hand-operable latches 106, 108 at the top of the tank.

The vacuum recovery tank 80 has a top wall 84, a bottom wall 86, a front wall 88, a back wall 90, a left sidewall (not shown), and a right sidewall 92; and the tank defines an interior space operable to hold liquid and soil (e.g., soil-containing cleaning solution that has been vacuumed up from an area of hard surface flooring). The tank also has a vacuum recovery inlet 98 at a front left portion of the top wall 84, a cleaning liquid transfer outlet 99 at an interior surface 87 of the bottom wall 86, and a dump outlet 100 at a lower portion of the front wall 88. The vacuum recovery inlet, the cleaning liquid transfer outlet, and the dump outlet are fluidly connected to the tank interior space. In addition, the tank-assembly dump hose 102 is fluidly connected to the dump outlet 100.

In this fashion, liquid and soil may be suctioned into the tank via the vacuum recovery inlet (e.g., via a length of vacuum hose connected to a floor tool or the like); and liquid and soil may be drained from the tank via the dump outlet and the dump hose (e.g., into a suitable receptacle, drain, or the like.) The top wall 84 has a circumferential rim 94 that defines a large opening 96. The opening provides a user with access to the tank interior space. The opening also enables the vacuum motor head assembly 18 (discussed in detail below) to be in fluid communication with the tank interior space when a user manually and removably positions (e.g., seats) the assembly 18 on the top wall 84 about the opening 96.

With regard to the fasteners, and as mentioned briefly above, two fasteners in the form of hand-operable latches (as at 104) are located at the base of the vacuum recovery tank 80. In further detail, one of the latches (as at 104) at the base of the tank is located at the tank right sidewall 92, and the other of the latches (not shown) at the base of the tank is located at the tank left sidewall (not shown). In use, a user may manually and removably position the tank on the bucket, and may do so without the use of a tool. With the tank on the bucket, a user may manually and releasably connect the tank to the bucket via the hand-operable latches (as at 104), and may do so without the use of a tool.

With further regard to the fasteners, and as mentioned briefly above, two fasteners in the form of hand-operable latches 106, 108 are located at the top of the vacuum recovery tank 80. In additional detail, latch 106 at the top of the tank is located at the tank top wall 84 to the right of the large opening 96, and latch 108 at the top of the tank is located at the tank top wall 84 to the left of the large opening 96. In use, a user may manually and removably position (e.g., seat) the vacuum motor head assembly 18 (discussed in detail below) on the top wall 84 about the opening 96. When the assembly 18 is positioned on the top wall 84 about the opening 96, a user may manually and releasably connect the positioned assembly to the vacuum recovery tank via the hand-operable latches 106, 108, and may do so without the use of a tool.

The four bend handle 14 is manually and removably connected to the bucket 24. As noted above, the bucket has a top wall 46 at the bucket upper end 32. The top wall is integral with the bucket circumferential sidewall 28, extends outward away from the circumferential sidewall and bucket interior space, and has several sections. The top-wall left section 52 has a cylindrical bore 56, and the top-wall right section 54 has a cylindrical bore 58—with each of the cylindrical bores having a bottom wall. The four bend handle 14 has a left leg 76 and a right leg 78. In manually and removably connecting the four bend handle to the bucket, the left leg is positioned in the cylindrical bore 56, and the right leg is positioned in the cylindrical bore 58.

The vacuum motor head assembly 18 has an outer housing 110, a vacuum motor assembly 112, and an automatic shutoff system in the form of a float shutoff assembly 114. The outer housing has an on/off switch 116, a main handle 118, a steering tab or handle 120, and a power cord 122 for manual and removable connection to a suitable AC electrical cord—for example, an AC electrical cord connectable to a conventional wall outlet. In use, a user may grasp or otherwise exert force on the steering tab to facilitate moving (e.g., pushing or pulling) the portable floor care system 10. The vacuum motor assembly 112 may have any suitable specifications. For example, if desired, the vacuum motor assembly may have a vacuum lift of 80 inches of water and an air flow of 60 cubic feet per minute. Alternatively, if desired, the vacuum motor assembly may have a vacuum lift of 77 inches of water and an air flow of 62 cubic feet per minute.

If desired, a DC vacuum motor head assembly may be used—either in place of or interchangeably with the vacuum motor head assembly 18. A DC power supply assembly may be used to power such a DC vacuum motor head assembly. If desired, the DC motor of the DC vacuum motor assembly may be a 36 volt DC motor. Also, if desired, the DC vacuum motor assembly may have a vacuum lift of 80 inches of water and an air flow of 60 cubic feet per minute. Alternatively, if desired, the DC vacuum motor assembly may have a vacuum lift of 77 inches of water and an air flow of 62 cubic feet per minute.

If desired, the DC power supply assembly may have a rechargeable Lithium-ion battery positioned in a battery box. The Lithium-ion battery may have any suitable specifications. For example, if desired, the Lithium-ion battery may be a 36 volt DC battery with a 20 amp hour rating. The DC power supply assembly also may have a fastener in the form of a strap connected to an exterior surface of the battery box. If desired, the strap may have a male snap member and a corresponding female snap member. In use, a user may manually and removably position the DC power supply assembly on the bucket, and may do so without the use of a tool. With the DC power supply assembly on the bucket, a user may manually and releasably connect the DC power supply assembly to the bucket via a fastener assembly, and may do so without the use of a tool. If desired, the fastener assembly may include the strap and the leg 78 of the four bend handle 14. For example, with the handle manually and removably connected to the reservoir (as discussed above), a user may wrap a portion of the strap around the leg 78, and releasably secure the male and female snap members to one another.

An example of a system with interchangeable AC and DC vacuum motor head assemblies is shown and described in U.S. Pat. No. 9,854,955, entitled "Floor Care System with Interchangeable AC and DC Vacuum Motor Assemblies" and issued on Jan. 2, 2018. The entire disclosure of U.S. Pat. No. 9,854,955 is incorporated into this patent document by reference.

Figure 3:
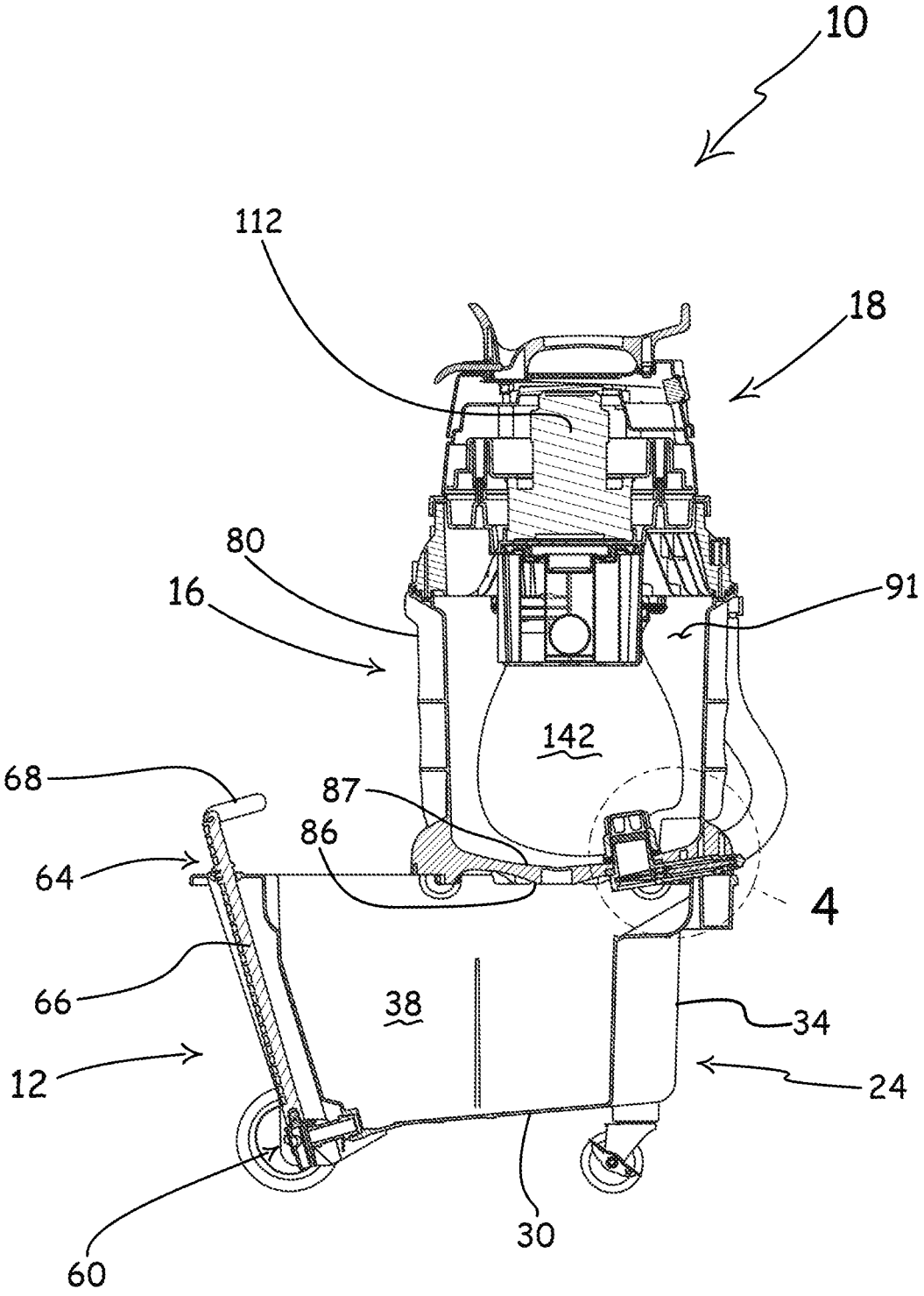
FIG. 3 is a cross-sectional view of the portable liquid-recycling liquid-reusing cleaning system of FIG. 1, taken along line 3-3 of FIG. 1.
Figure 4:
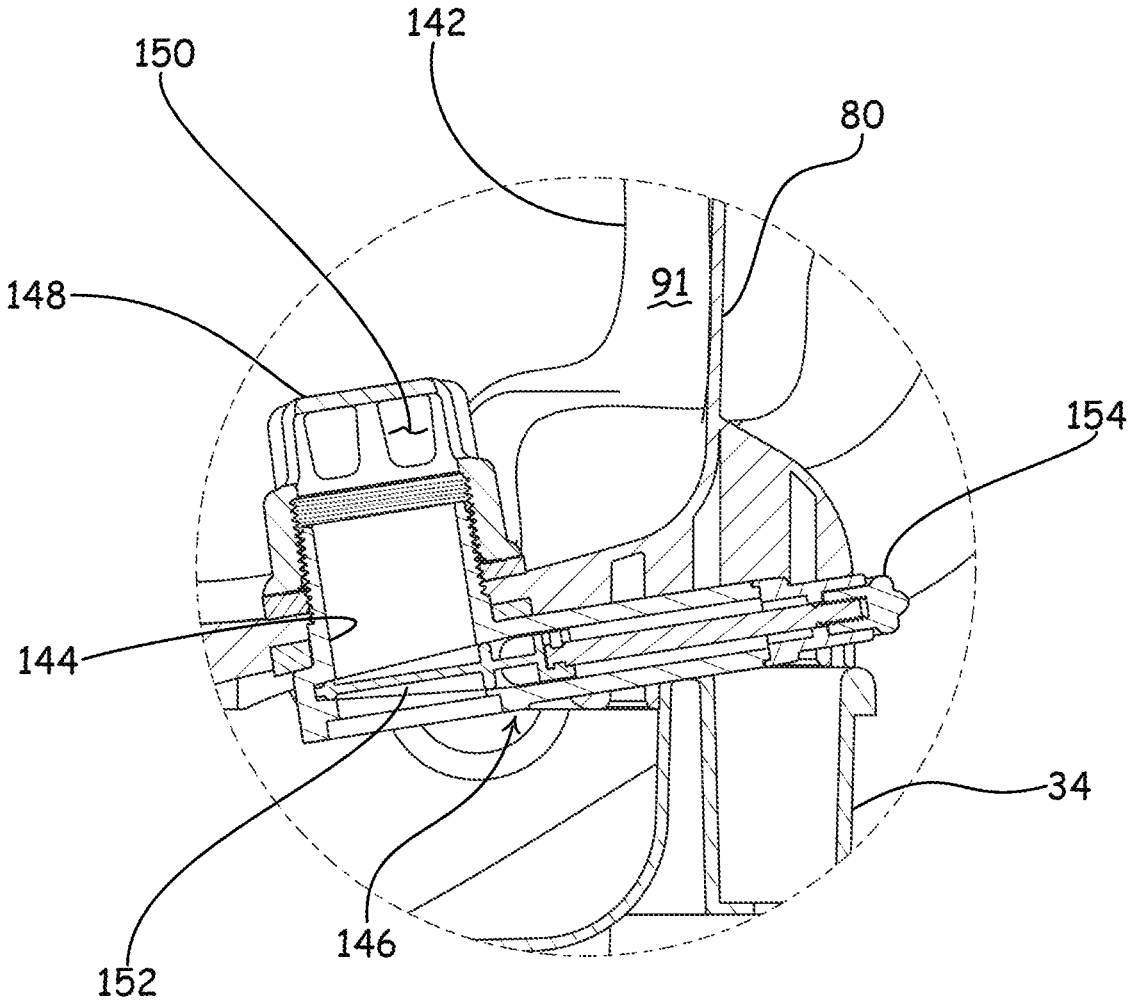
FIG. 4 is a portion of the cross-sectional view of FIG. 3, enlarged for magnification purposes.

With reference to FIGS. 3 and 4, the portable floor care system embodiment 10 has a vacuum motor assembly 112 and a filter bag 142. The opening or mouth of the filter bag is positioned at the vacuum recovery inlet 98. The embodiment 10 also has a standpipe 144 and a gate valve assembly 146. The standpipe has a "gazeebo" nut 148 at an upper end, with openings (as at 150) defining cleaning liquid entry openings. The gate valve assembly has a gate valve slide gate 152 and a gate valve handle 154.

Figure 5:
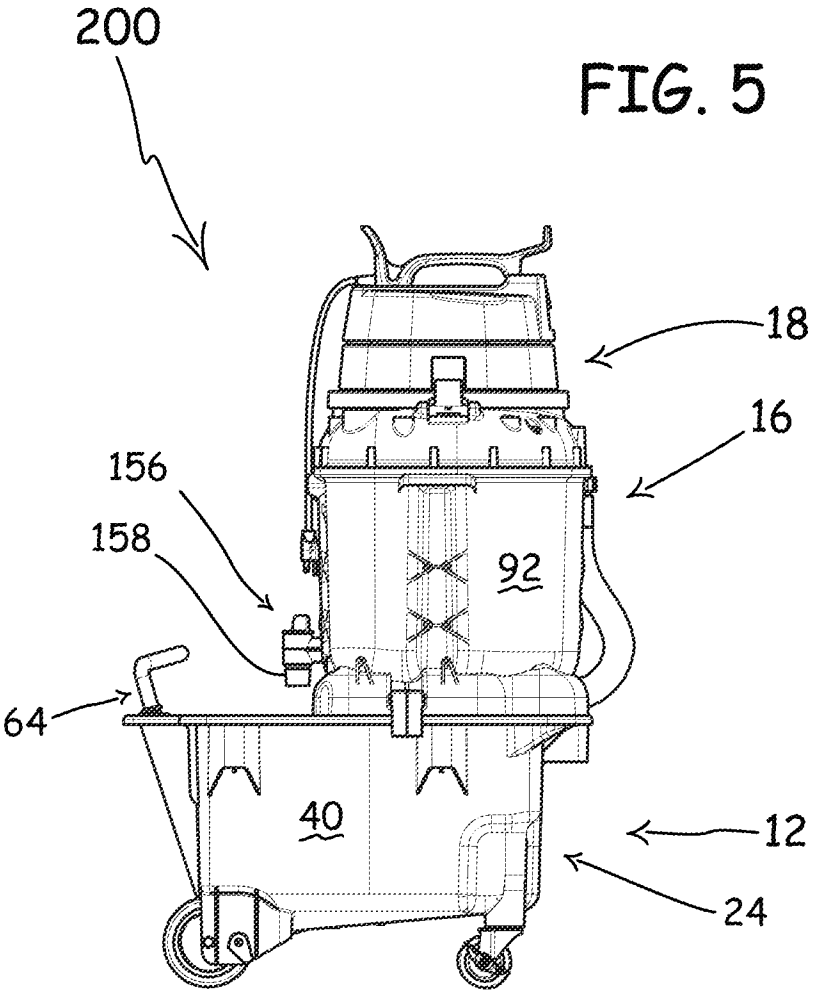
FIG. 5 is a right side view of another embodiment of the portable liquid-recycling liquid-reusing cleaning system for hard surface flooring, in accordance with the principles of the invention.
Figure 6:
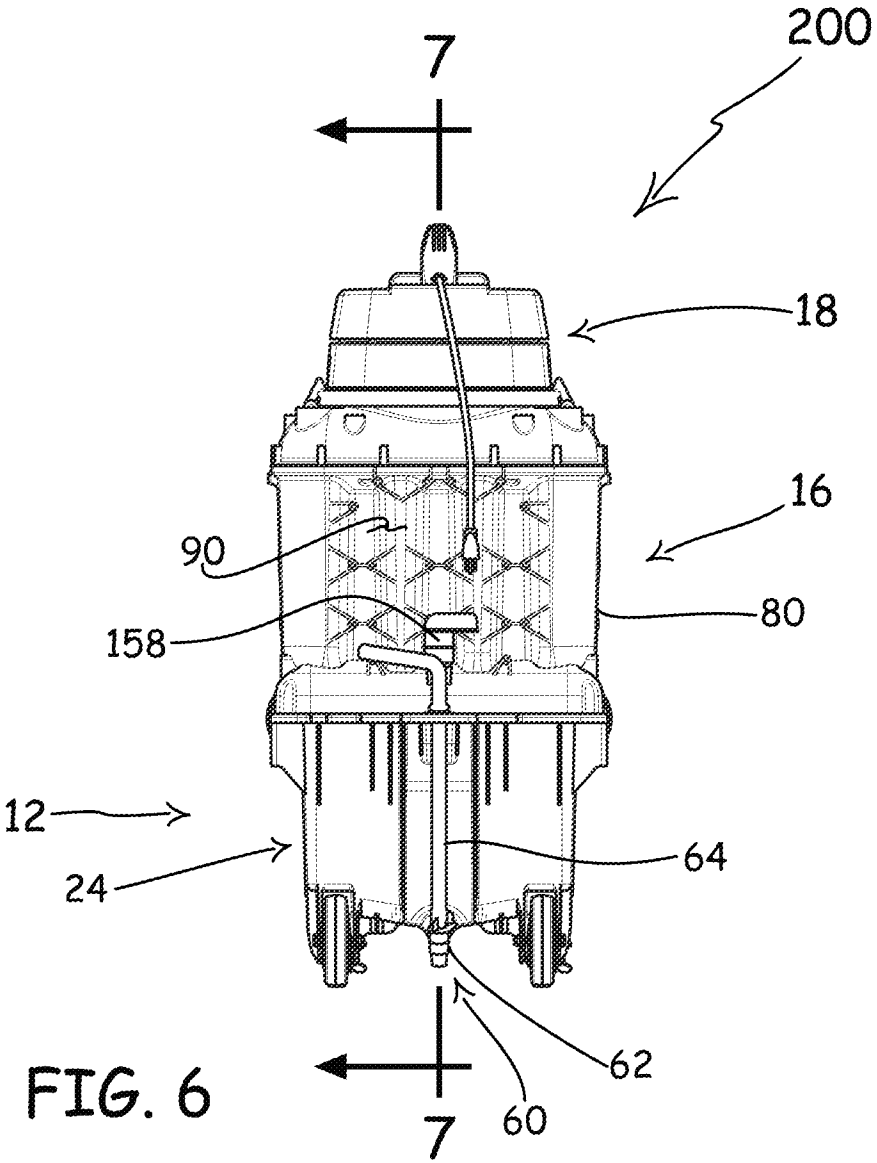
FIG. 6 is a back view of the portable liquid-recycling liquid-reusing cleaning system of FIG. 5.
Figure 7:
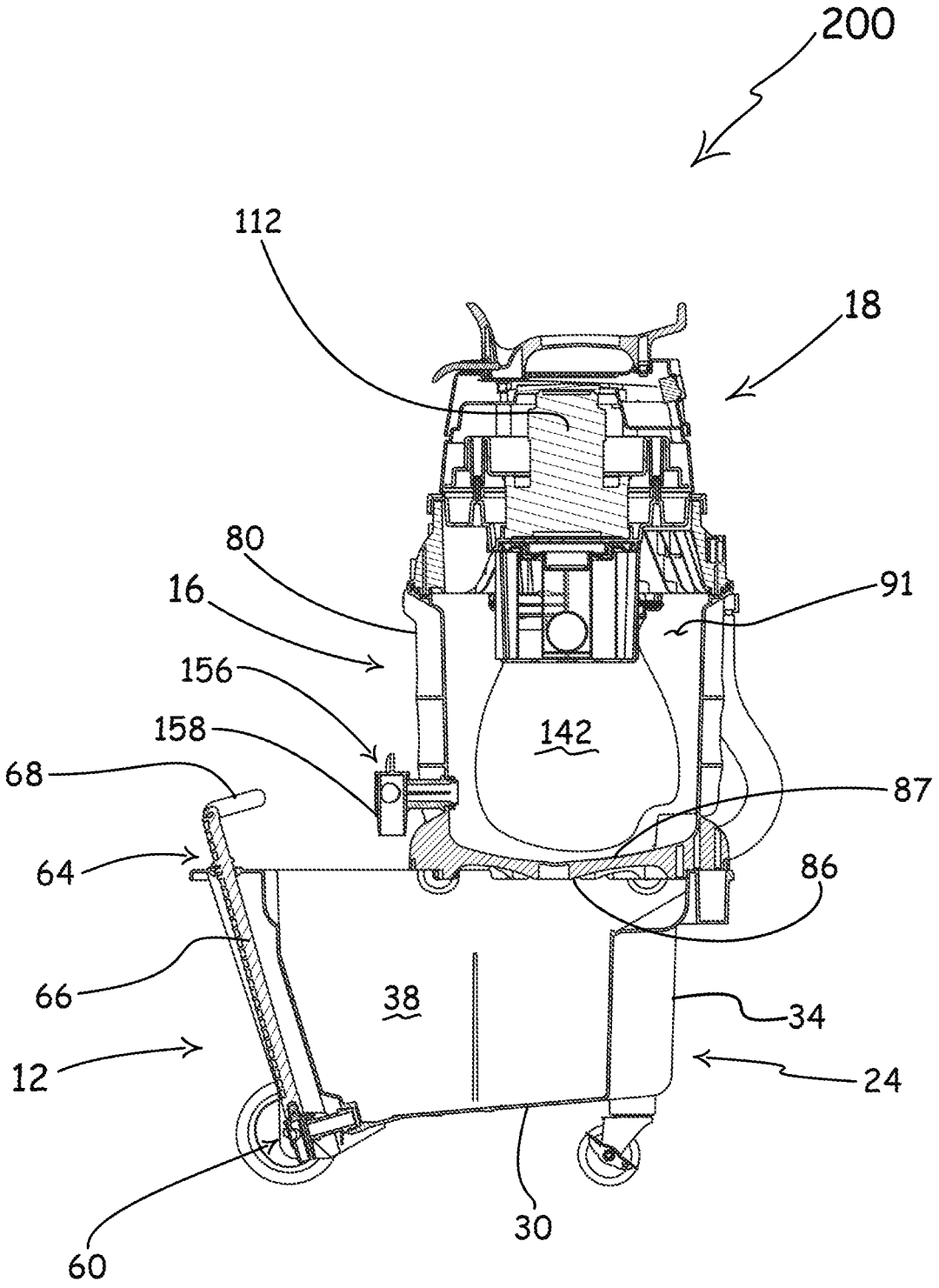
FIG. 7 is a cross-sectional view of the portable liquid-recycling liquid-reusing cleaning system of FIGS. 5 and 6, taken along line 7-7 of FIG. 6.

With reference to FIGS. 5-7, the portable floor care system embodiment 200 has a spigot assembly 156 and a spigot 158.

Figure 8:
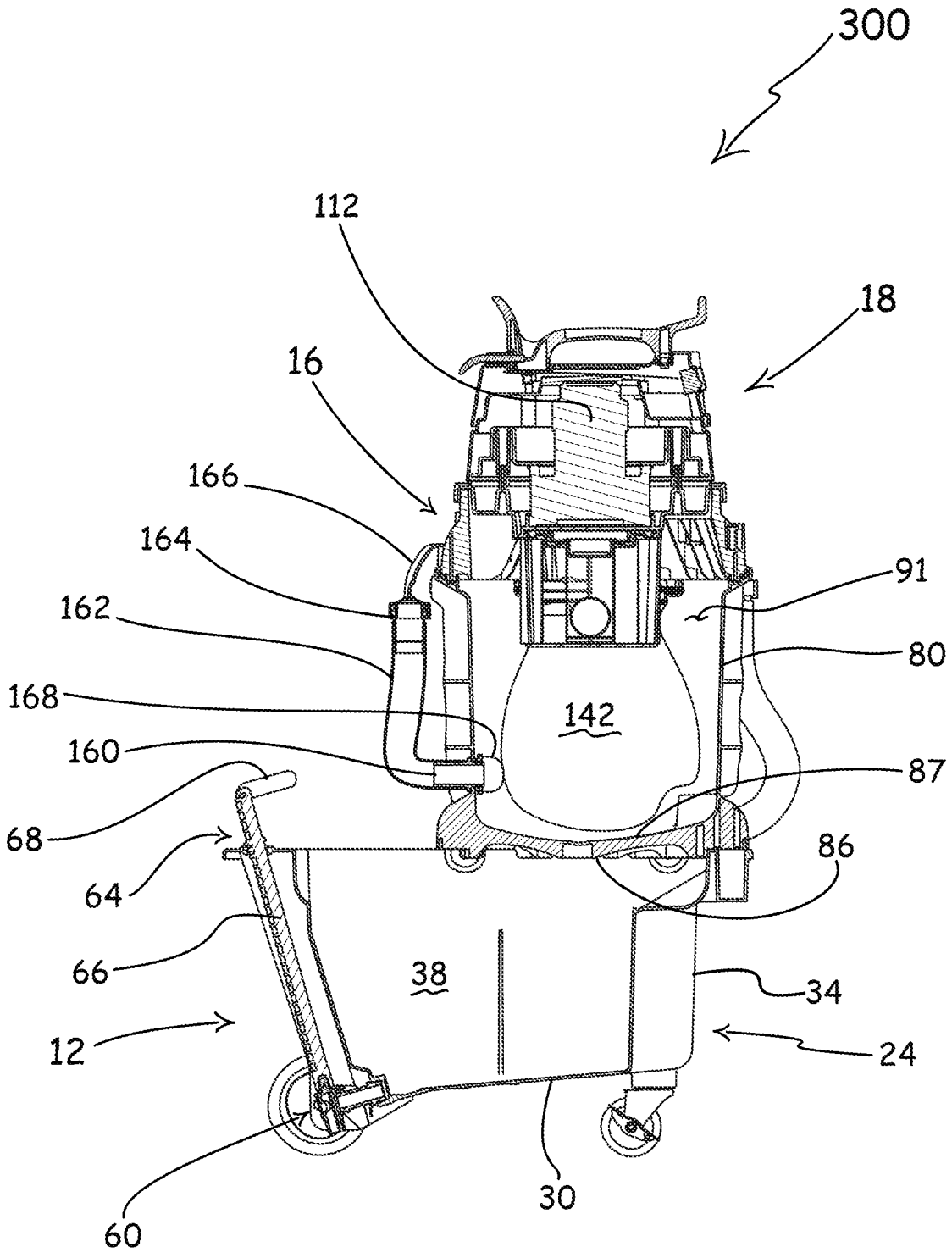
FIG. 8 is a cross-sectional view of an additional embodiment of the portable liquid-recycling liquid-reusing cleaning system for hard surface flooring, in accordance with the principles of the invention.

With reference to FIG. 8, the portable floor care system embodiment 300 has a tube 160, a cleaning liquid transfer hose 162, a cap 164, a strap 166, and a mushroom filter 168.

Figure 9:
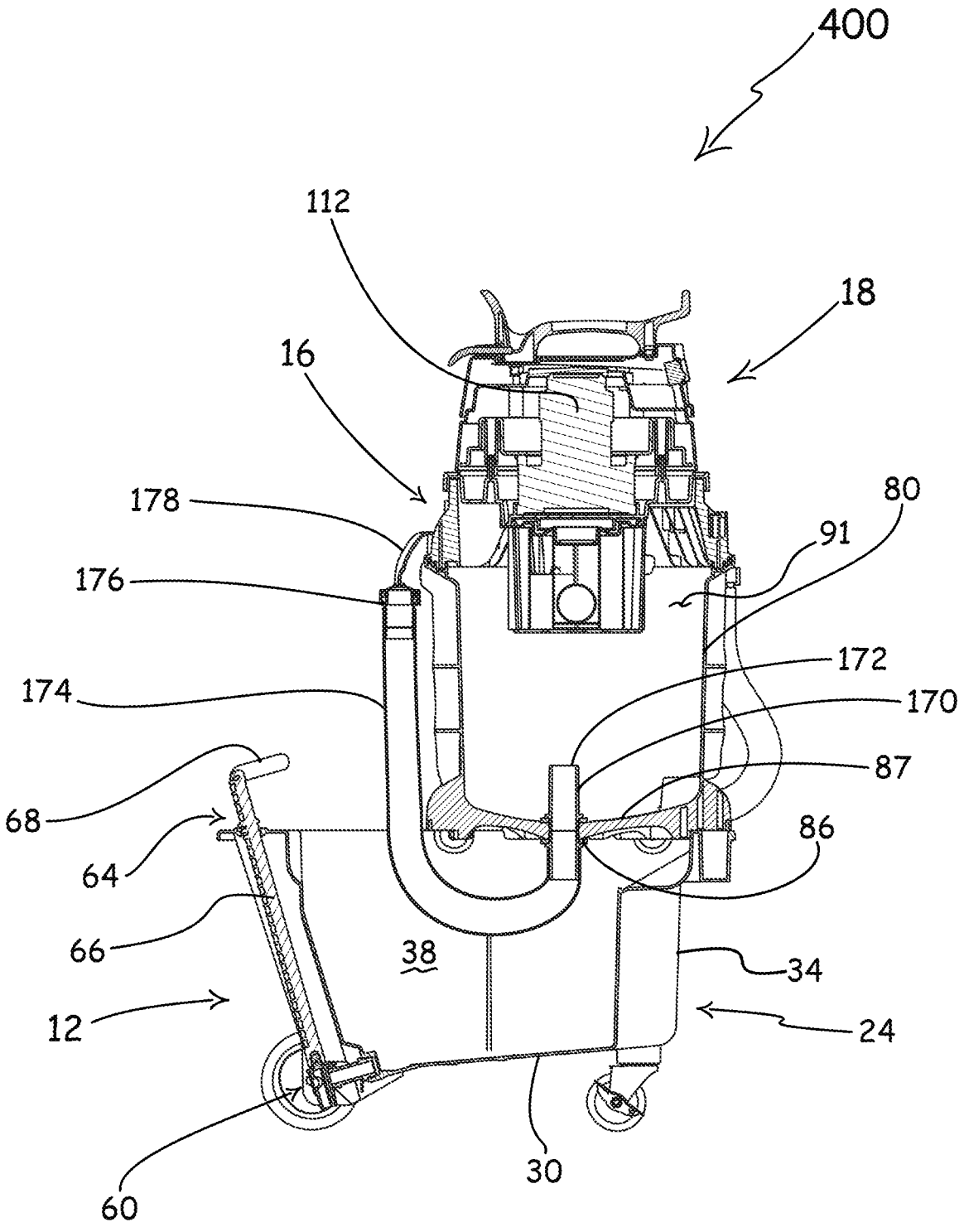
FIG. 9 is a cross-sectional view of a further embodiment of the portable liquid-recycling liquid-reusing cleaning system for hard surface flooring, in accordance with the principles of the invention.

With reference to FIG. 9, the portable floor care system embodiment 400 has a standpipe 170, a cleaning liquid entry opening 172, a cleaning liquid transfer hose 174, a cap 176, and a strap 178.

Figure 10:
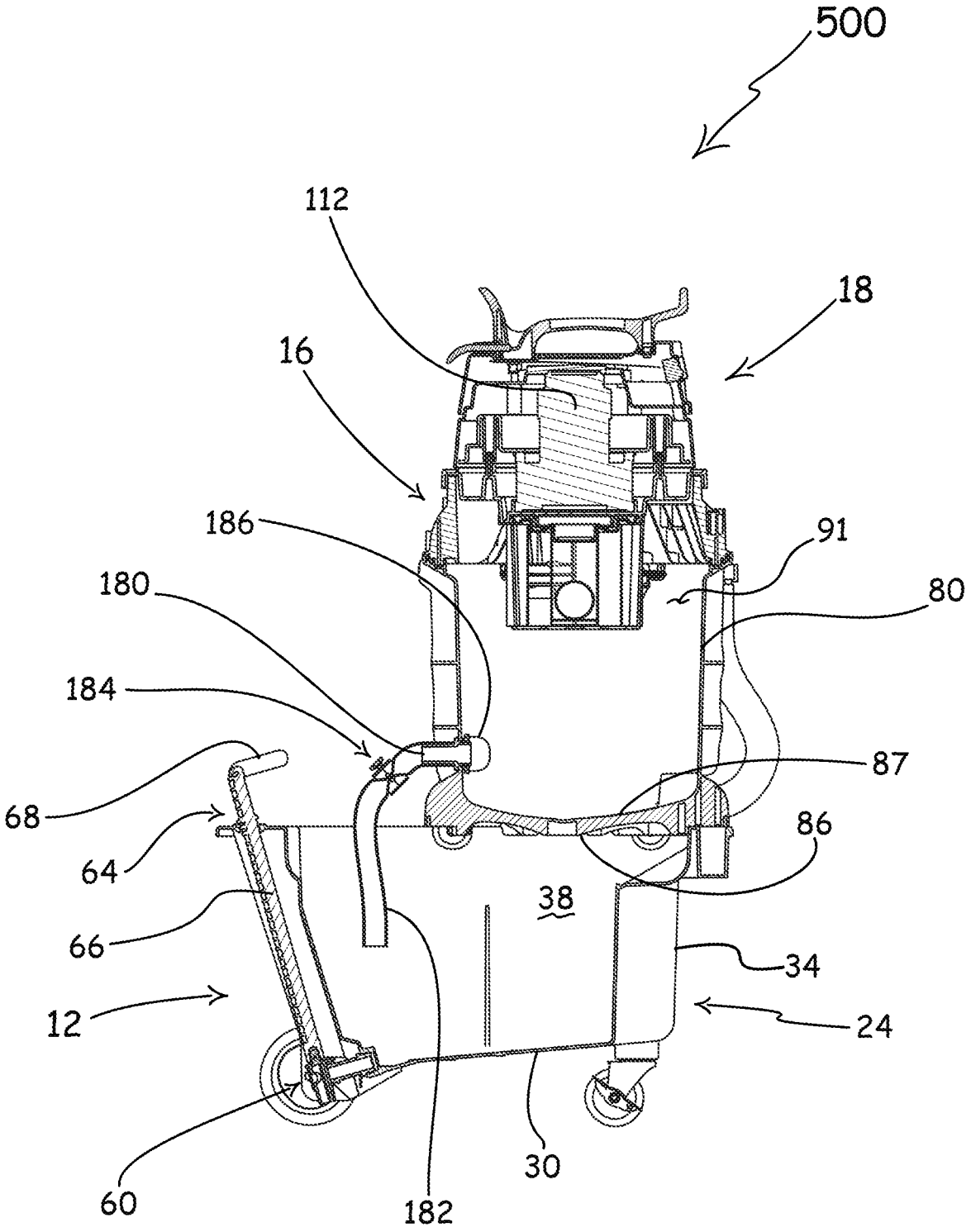
FIG. 10 is a cross-sectional view of yet another embodiment of the portable liquid-recycling liquid-reusing cleaning system for hard surface flooring, in accordance with the principles of the invention.

With reference to FIG. 10, the portable floor care system embodiment 500 has a tube 180, a cleaning liquid transfer hose 182, a pinch valve 184, and a mushroom filter 186.

Figure 11:
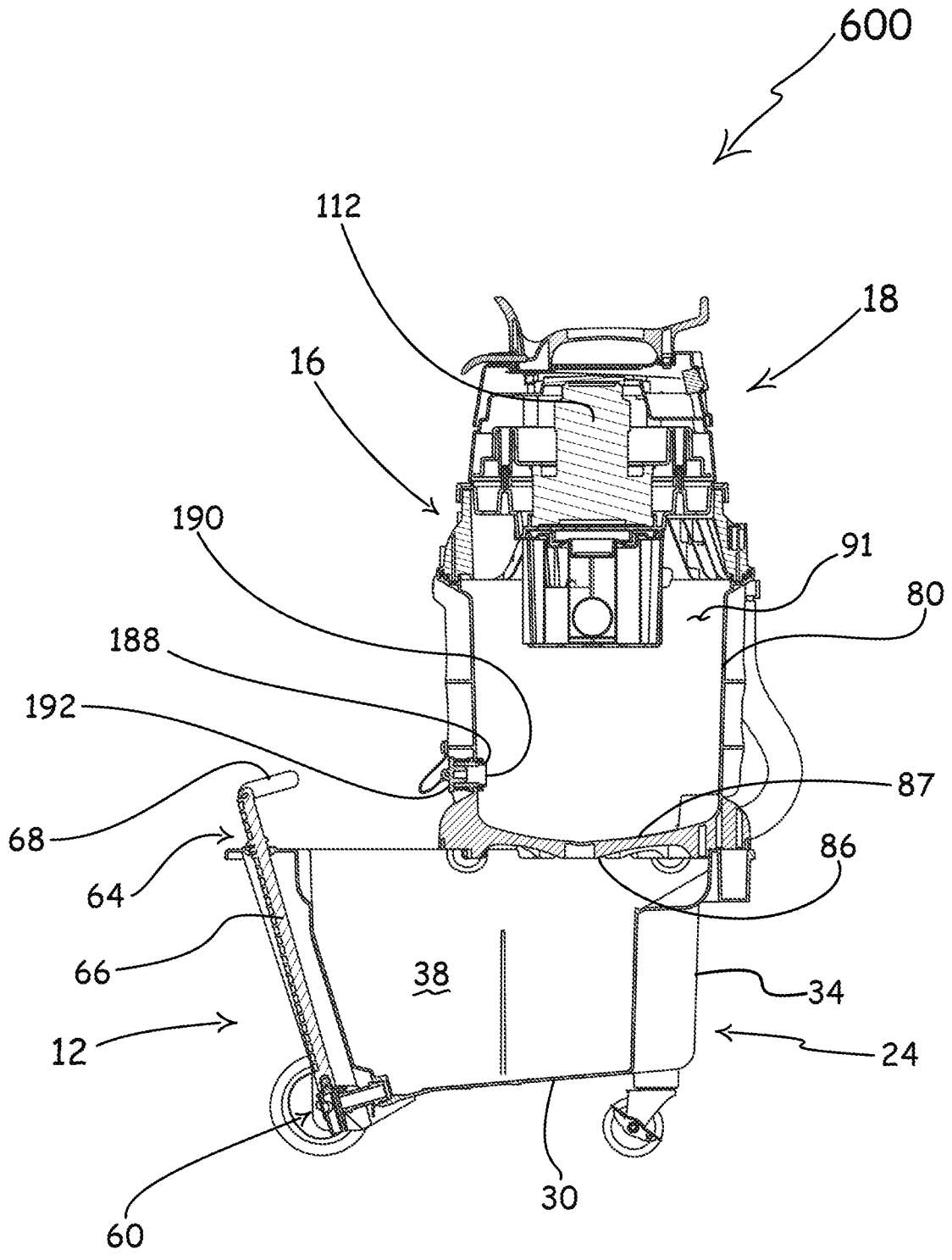
FIG. 11 is a cross-sectional view of yet an additional embodiment of the portable liquid-recycling liquid-reusing cleaning system for hard surface flooring, in accordance with the principles of the invention.

With reference to FIG. 11, the portable floor care system embodiment 600 has a tube 188, a cleaning liquid entry opening 190, and a plug 192.

Figure 12:
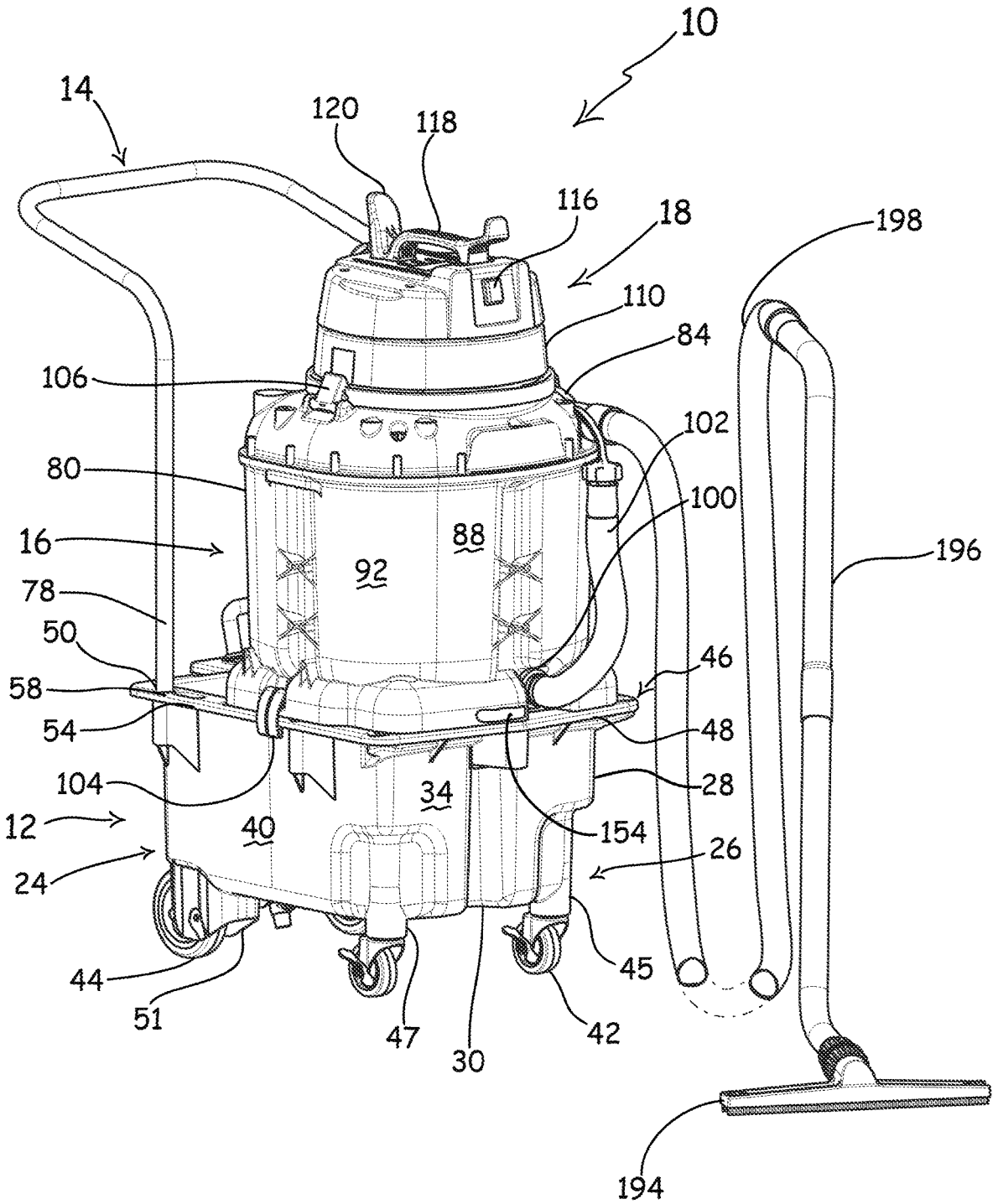
FIG. 12 is a perspective view of the portable liquid-recycling liquid-reusing cleaning system of FIG. 1, with the cleaning system further including a floor tool, a vacuum wand, and a vacuum hose.

With reference to FIG. 12, the portable floor care system embodiment 10 is shown in combination with a squeegee floor tool 194, a vacuum wand 196, and a vacuum hose 198.

Figure 13:
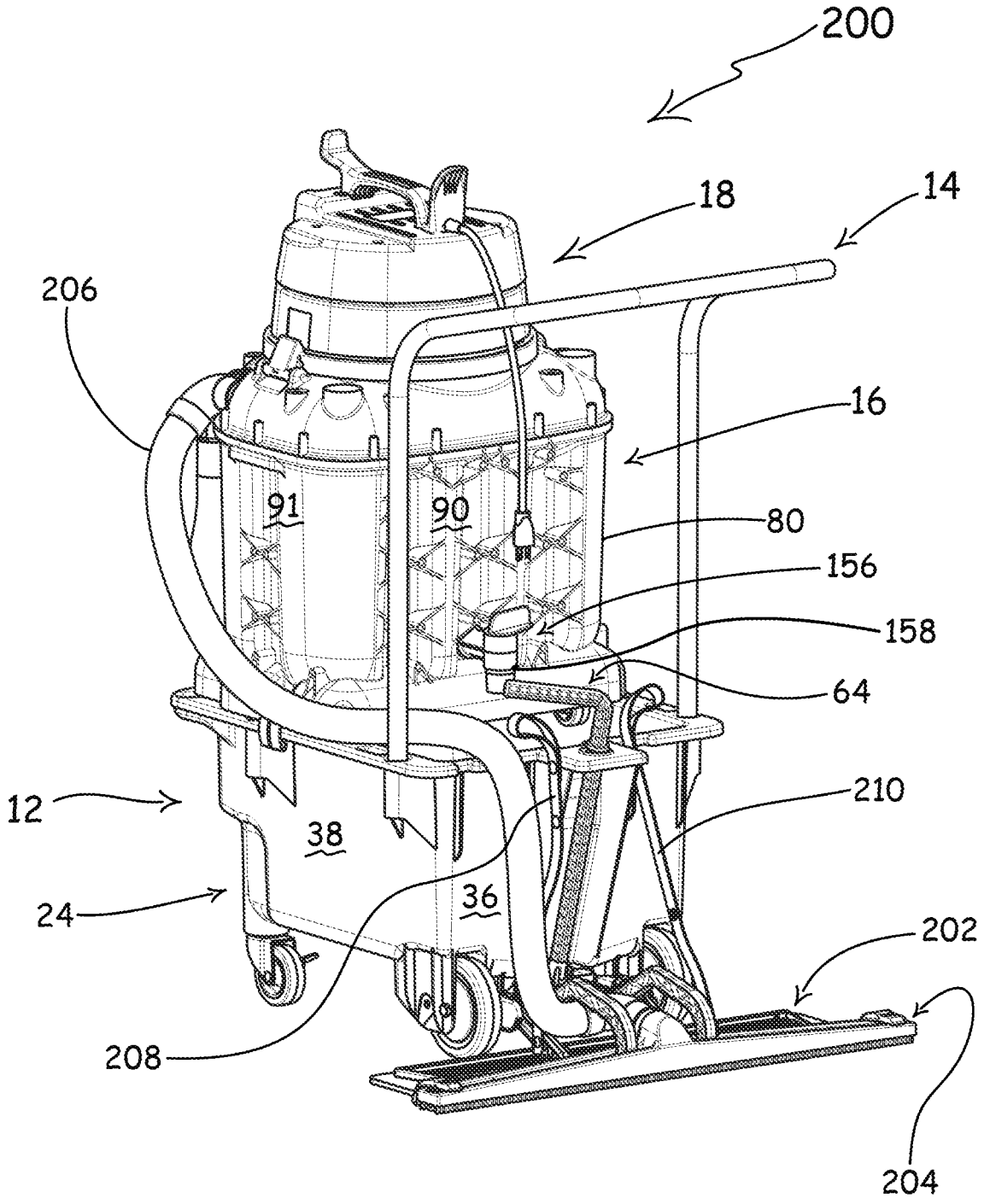
FIG. 13 is a perspective view of the portable liquid-recycling liquid-reusing cleaning system of FIGS. 5-7, with the cleaning system further including a liquid spreader assembly, a squeegee head assembly, and a vacuum hose.

With reference to FIG. 13, the portable floor care system embodiment 200 is shown in combination with a liquid spreader assembly 202, a squeegee head assembly 204, a vacuum hose 206, a liquid spreader assembly strap 208, and a squeegee head assembly strap 210.

Figure 14:
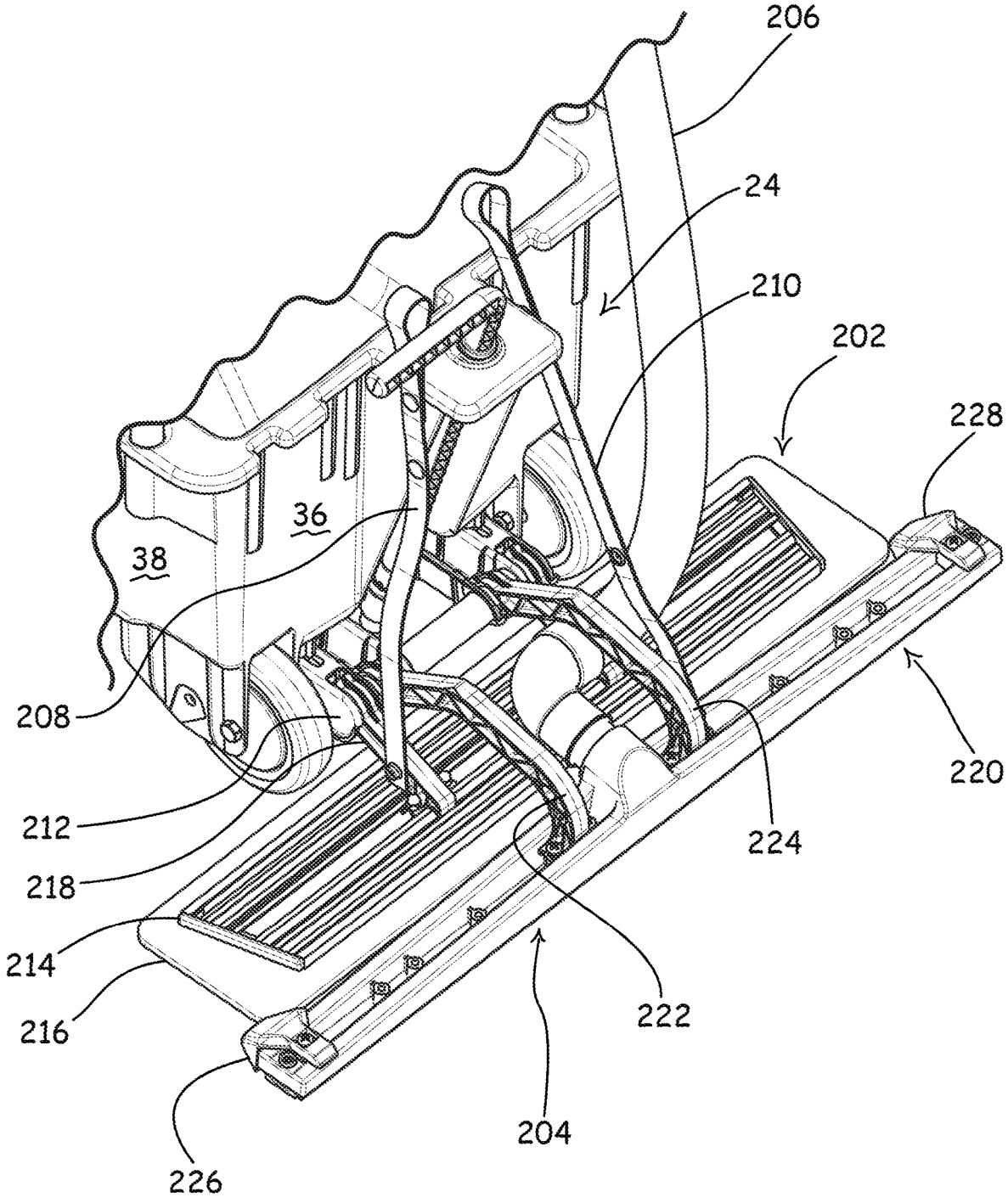
FIG. 14 is a perspective view of a portion of a portable liquid-recycling liquid-reusing cleaning system substantially similar to the portable liquid-recycling liquid-reusing cleaning system of FIG. 13.

With reference to FIG. 14, the portable floor care system embodiment 200 is shown in combination with a liquid spreader assembly 202, a squeegee head assembly 204, a vacuum hose 206, a liquid spreader assembly strap 208, and a squeegee head assembly strap 210. The embodiment 200 also has a hitch assembly 212. The liquid spreader assembly 202 has a frame 214, a spreader pad 216, and a pair of connecting arms (as at 218). The squeegee head assembly 204 has a frame assembly 220, a pair of connecting arms 222, 224, and a pair of plow members 226, 228.

Figure 15:
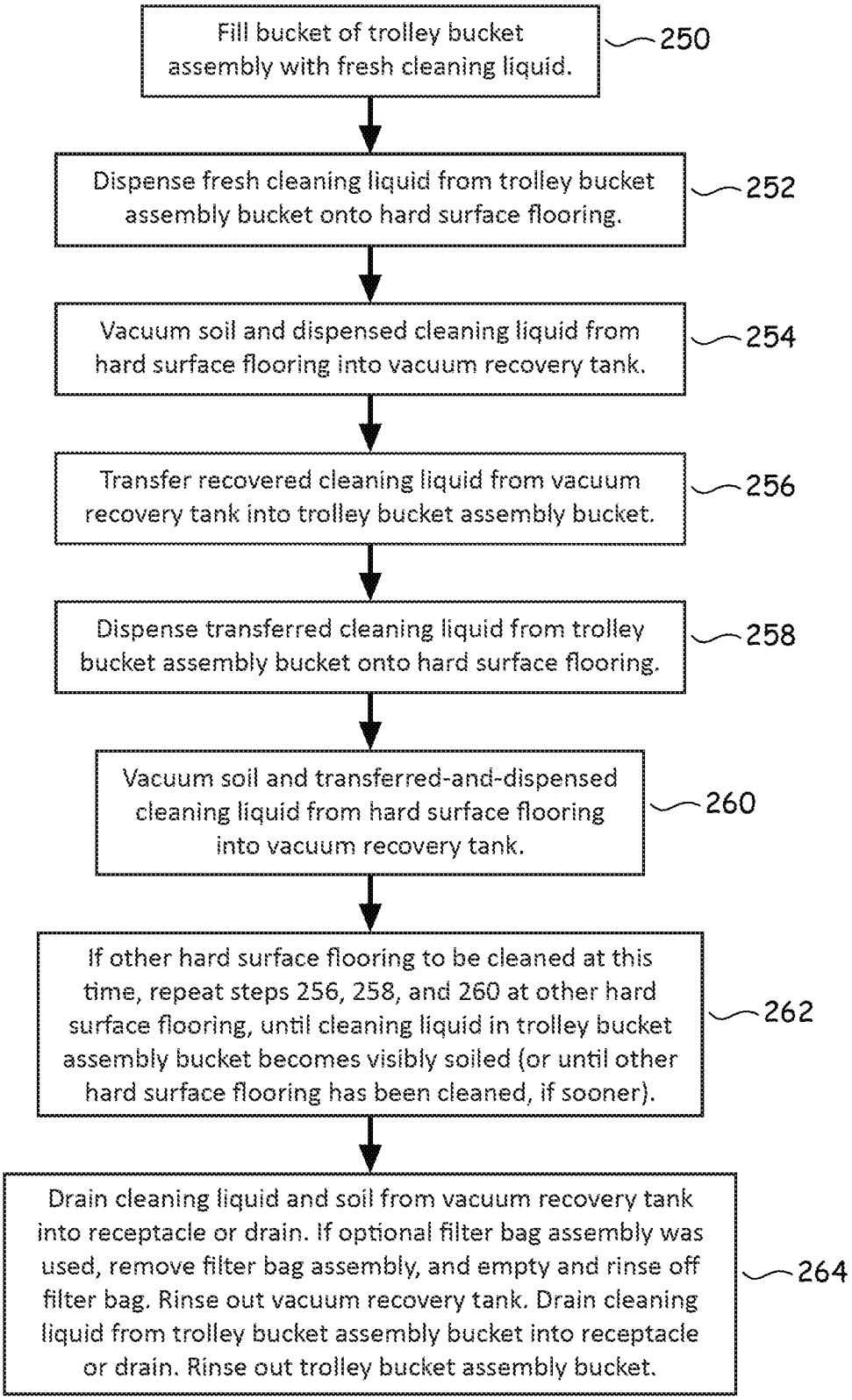
FIG. 15 is a flow chart of a method of cleaning hard surface flooring with the portable liquid-recycling liquid-reusing cleaning system of FIG. 1, in accordance with the principles of the invention.

With reference to FIG. 15, an exemplary method is shown.

The means for regulating the flow of cleaning liquid from the vacuum recovery tank to the bucket may include any suitable valve, tube, flexible hose, cap, plug, or combination thereof.

Typically a portable liquid-recycling liquid-reusing cleaning system of the present invention does not include a pump to assist in transferring cleaning liquid from the vacuum recovery tank through the cleaning liquid transfer outlet to the bucket. Instead, such a portable cleaning system uses the natural force of gravity to facilitate this transfer. With reference to the Figures, the portable liquid-recycling liquid-reusing cleaning system embodiments shown are free of such a pump.

Also, typically a portable liquid-recycling liquid-reusing cleaning system of the present invention does not include a pump to assist in dispensing cleaning liquid from the bucket through the spigot—either directly or indirectly onto an area of hard surface flooring. Instead, such a portable cleaning system uses the natural force of gravity to facilitate dispensing cleaning liquid from the bucket through the spigot. With reference to the Figures, the portable liquid-recycling liquid-reusing cleaning system embodiments shown are free of such a pump.

A portable liquid-recycling liquid-reusing cleaning system of the present invention may be made using any suitable material(s) and manufacturing technique(s). For example, if desired, the bucket may be made of polypropylene using injection molding, and the vacuum recovery tank may be made of polyethylene via rotational molding.

While the present invention has been illustrated by a description of embodiments, and while the illustrative embodiments have been described in considerable detail, it is not the intention of the inventor to restrict or in any way limit the scope of the following claims to such detail. Additional advantages and modifications readily will appear to those skilled in the art upon a reading of this patent document. The invention, in its broader aspects, is therefore not limited to the specific details, representative apparatus and methods, and illustrative examples shown and described in this patent document. Accordingly, departures may be made from such details without departing from the spirit or scope of the inventor's general inventive concept.

What is claimed is:

1. A portable liquid-recycling liquid-reusing cleaning system for use in cleaning hard surface flooring, comprising:

a trolley bucket assembly including:

a bucket operable to hold cleaning liquid;

a wheeled chassis; and a spigot fluidly connected to the bucket, the spigot including a valve that is adjustable throughout a range from a fully open position to a fully closed position, whereby when the bucket contains cleaning liquid, a user may dispense and regulate the flow of cleaning liquid from the bucket through the spigot by manually adjusting the spigot;

a vacuum recovery tank positioned on the trolley bucket assembly, the vacuum recovery tank operable to hold cleaning liquid and soil, the vacuum recovery tank including a bottom wall, a vacuum recovery inlet, and a cleaning liquid transfer outlet through which cleaning liquid from the vacuum recovery tank may be transferred to the bucket for reuse, with the vacuum recovery tank bottom wall including an interior surface, and with the cleaning liquid transfer outlet including a cleaning liquid entry opening through which cleaning liquid from the vacuum recovery tank enters the cleaning liquid transfer outlet; and a vacuum motor assembly fluidly connected to the vacuum recovery tank;

with the cleaning liquid entry opening of the cleaning liquid transfer outlet positioned above at least a portion of the vacuum recovery tank bottom wall interior surface, thereby inhibiting soil that settles on the portion of the vacuum recovery tank bottom wall interior surface from passing through the vacuum recovery tank cleaning liquid transfer outlet;

whereby a user may dispense cleaning liquid from the bucket through the spigot onto hard surface flooring, may vacuum dispensed cleaning liquid and soil from hard surface flooring through the vacuum recovery inlet into the vacuum recovery tank, may transfer recovered cleaning liquid from the vacuum recovery tank through the cleaning liquid transfer outlet to the bucket for reuse, and may dispense transferred cleaning liquid from the bucket through the spigot onto hard surface flooring.

2. The portable liquid-recycling liquid-reusing cleaning system of claim 1 further including means for regulating the flow of cleaning liquid from the vacuum recovery tank to the bucket.

3. The portable liquid-recycling liquid-reusing cleaning system of claim 2 wherein the means for regulating the flow of cleaning liquid from the vacuum recovery tank to the bucket includes one or more of a valve, a tube, a flexible hose, a cap, and a plug.

4. The portable liquid-recycling liquid-reusing cleaning system of claim 2 wherein at least a portion of the cleaning liquid transfer outlet is at the vacuum recovery tank bottom wall.

5. The portable liquid-recycling liquid-reusing cleaning system of claim 2 wherein the vacuum recovery tank includes a circumferential sidewall, and at least a portion of the cleaning liquid transfer outlet is at the circumferential sidewall.

6. The portable liquid-recycling liquid-reusing cleaning system of claim 2 further including a flexible hose fluidly connected to the liquid transfer outlet, the flexible hose operable to guide cleaning liquid from the vacuum recovery tank into the bucket.

7. The portable liquid-recycling liquid-reusing cleaning system of claim 2 further including a floor tool fluidly connected to the vacuum recovery inlet, whereby soil and dispensed cleaning liquid may be vacuumed from hard surface flooring through the floor tool into the vacuum recovery tank.

8. The portable liquid-recycling liquid-reusing cleaning system of claim 2 further including a liquid spreader assembly and a squeegee head assembly, the squeegee head assembly fluidly connected to the vacuum recovery inlet, the liquid spreader assembly operable to spread on hard surface flooring cleaning liquid that is dispensed from the bucket through the spigot, and the squeegee head assembly operable to vacuum soil and dispensed cleaning liquid from hard surface flooring into the vacuum recovery tank, thereby recovering cleaning liquid for reuse.

9. The portable liquid-recycling liquid-reusing cleaning system of claim 1 wherein at least a portion of the cleaning liquid transfer outlet is at the vacuum recovery tank bottom wall.

10. The portable liquid-recycling liquid-reusing cleaning system of claim 1 wherein the vacuum recovery tank includes a circumferential sidewall, and at least a portion of the cleaning liquid transfer outlet is at the circumferential sidewall.

11. The portable liquid-recycling liquid-reusing cleaning system of claim 1 further including a flexible hose fluidly connected to the liquid transfer outlet, the flexible hose operable to guide cleaning liquid from the vacuum recovery tank into the bucket.

12. The portable liquid-recycling liquid-reusing cleaning system of claim 1 further including a filter operable to filter cleaning liquid and soil vacuumed from hard surface flooring, the filter positioned in a fluid flow path between the vacuum recovery inlet and the bucket.

13. The portable liquid-recycling liquid-reusing cleaning system of claim 1 further including a spigot handle connected to the spigot, the spigot handle comprising an elongated upwardly-extending member, whereby a user may manually adjust the spigot by manually rotating the spigot handle.

14. The portable liquid-recycling liquid-reusing cleaning system of claim 1 wherein the vacuum recovery tank includes a dump outlet, and the portable liquid-recycling liquid-reusing cleaning system further includes a dump hose fluidly connected to the dump outlet, whereby a user may drain cleaning liquid and soil from the vacuum recovery tank into a suitable receptacle or drain via the dump outlet and dump hose.

15. A method of cleaning hard surface flooring with a portable liquid-recycling liquid-reusing cleaning system, comprising:

providing a portable liquid-recycling liquid-reusing cleaning system, comprising:

a trolley bucket assembly including:

a bucket operable to hold cleaning liquid;

a wheeled chassis; and a spigot fluidly connected to the bucket, the spigot including a valve that is adjustable throughout a range from a fully open position to a fully closed position, whereby when the bucket contains cleaning liquid, a user may dispense and regulate the flow of cleaning liquid from the bucket through the spigot by manually adjusting the spigot;

a vacuum recovery tank positioned on the trolley bucket assembly, the vacuum recovery tank operable to hold cleaning liquid and soil, the vacuum recovery tank including a bottom wall, a vacuum recovery inlet, and a cleaning liquid transfer outlet through which cleaning liquid from the vacuum recovery tank may be transferred to the bucket for reuse, with the vacuum recovery tank bottom wall including an interior surface, and with the cleaning liquid transfer outlet including a cleaning liquid entry opening through which cleaning liquid from the vacuum recovery tank enters the cleaning liquid transfer outlet; and a vacuum motor assembly fluidly connected to the vacuum recovery tank;

with the cleaning liquid entry opening of the cleaning liquid transfer outlet positioned above at least a portion of the vacuum recovery tank bottom wall interior surface, thereby inhibiting soil that settles on the portion of the vacuum recovery tank bottom wall interior surface from passing through the vacuum recovery tank cleaning liquid transfer outlet;

filling at least a portion of the bucket with a cleaning liquid;

dispensing at least a portion of the cleaning liquid from the bucket onto hard surface flooring via the spigot by manually adjusting the spigot;

vacuuming soil and at least some of the portion of the dispensed cleaning liquid from the hard surface flooring into the vacuum recovery tank via the vacuum recovery inlet, thereby removing soil and recovering cleaning liquid from hard surface flooring; and transferring at least a portion of the recovered cleaning liquid from the vacuum recovery tank into the bucket via the cleaning liquid transfer outlet.

16. The method of claim 15 further including dispensing at least a portion of the transferred cleaning liquid from the bucket onto hard surface flooring via the spigot by manually adjusting the spigot.

17. The method of claim 15 further including allowing the soil and the cleaning liquid that has been vacuumed into the vacuum recovery tank to dwell in the vacuum recovery tank for a period of time sufficient to enable at least some of the soil to settle on the portion of the vacuum recovery tank bottom wall interior surface.

18. The method of claim 15 wherein the portable liquid-recycling liquid-reusing cleaning system further includes a floor tool fluidly connectable to the vacuum recovery inlet, whereby when the floor tool is fluidly connected to the vacuum recovery inlet, the vacuuming step may be performed using the floor tool.

19. The method of claim 18 wherein the portable liquid-recycling liquid-reusing cleaning system further includes a liquid spreader assembly connectable to the trolley bucket assembly, the liquid spreader assembly including a frame and a spreader pad, the liquid spreader assembly operable to spread on hard surface flooring cleaning liquid dispensed from the bucket through the spigot, whereby when the liquid spreader assembly is connected to the trolley bucket assembly, dispensed cleaning liquid may be spread on hard surface flooring.

20. The method of claim 19 wherein the floor tool comprises a squeegee head assembly connectable to the trolley bucket assembly, the squeegee head assembly fluidly connectable to the vacuum recovery inlet, the squeegee head assembly operable to vacuum soil and dispensed cleaning liquid from hard surface flooring into the vacuum recovery tank, whereby when the squeegee head assembly is connected to the trolley bucket assembly, and the squeegee head assembly is fluidly connected to the vacuum recovery inlet, the vacuuming step may be performed using the squeegee head assembly.

21. The method of claim 18 wherein the portable liquid-recycling liquid-reusing cleaning system further includes a filter operable to filter cleaning liquid and soil vacuumed from hard surface flooring, the filter positioned in a fluid flow path between the floor tool and the bucket, whereby cleaning liquid and soil vacuumed from hard surface flooring may be filtered before the transferring step.

22. The method of claim 15 wherein the portable liquid-recycling liquid-reusing cleaning system further includes a spigot handle connected to the spigot, the spigot handle comprising an elongated upwardly-extending member, whereby a user may manually adjust the spigot by manually rotating the spigot handle.

23. The method of claim 15 wherein the vacuum recovery tank includes a dump outlet, and the portable liquid-recycling liquid-reusing cleaning system further includes a dump hose fluidly connected to the dump outlet, whereby a user may drain cleaning liquid and soil from the vacuum recovery tank into a suitable receptacle or drain via the dump outlet and dump hose.

* * * * *